US008782932B2

(12) United States Patent
Rouzaud Giannetti

(10) Patent No.: US 8,782,932 B2
(45) Date of Patent: Jul. 22, 2014

(54) TIMELESS IDENTIFICATION PASSPORT

(75) Inventor: Françoise Rouzaud Giannetti, Toulouse (FR)

(73) Assignee: Francoise Giannetti Rouzaud, Entreprise personelle commercant, Toulouse (FR)

( * ) Notice: Subject to any disclaimer, the term of this patent is extended or adjusted under 35 U.S.C. 154(b) by 251 days.

(21) Appl. No.: 13/266,822

(22) PCT Filed: Apr. 27, 2010

(86) PCT No.: PCT/EP2010/055595

§ 371 (c)(1), (2), (4) Date: Jan. 18, 2012

(87) PCT Pub. No.: WO2010/125045

PCT Pub. Date: Nov. 4, 2010

(65) Prior Publication Data

US 2012/0102794 A1 May 3, 2012

(30) Foreign Application Priority Data

Apr. 28, 2009 (FR) ..... 09 02061

(51) Int. Cl.

| | |
|---|---|
| ***G09F 1/00*** | (2006.01) |
| ***A47G 1/06*** | (2006.01) |
| ***A61G 17/00*** | (2006.01) |
| ***E01F 9/011*** | (2006.01) |
| ***E04H 13/00*** | (2006.01) |

(52) U.S. Cl.

CPC ... *G09F 1/00* (2013.01); *A47G 1/06* (2013.01); *A61G 17/00* (2013.01); *E01F 9/011* (2013.01); *E04H 13/00* (2013.01)

USPC ..... 40/124.05; 40/766; 40/765; 27/1; 52/103

(58) Field of Classification Search

CPC ..... G09F 1/00; A47G 1/06

USPC ..... 40/124.05, 766, 765; 27/1; 52/103

See application file for complete search history.

(56) References Cited

U.S. PATENT DOCUMENTS 5,524,373 A * 6/1996 Plumly ..... 40/600
5,695,066 A * 12/1997 Bartlett ..... 206/575

(Continued)

FOREIGN PATENT DOCUMENTS

FR 2030331 11/1970
KR 20050023073 3/2005

OTHER PUBLICATIONS

International Search Report dated Jun. 30, 2010, corresponding to PCT/EP2010/055595.

*Primary Examiner* — Syed A Islam
(74) *Attorney, Agent, or Firm* — Young & Thompson

(57) ABSTRACT

A funerary article for the identification and perpetuation of the memory of a deceased individual in a timeless manner, made of unalterable material, includes: a marked element (1) with a unique code that is assigned to the deceased individual, and on a pair of plates (3, 4) held together by an attachment member, both being marked with the unique code, the second plate including data for identification of the deceased individual in natural language to constitute a device for identification and remembrance. The marked element (1) is available when the Funeral Services take charge of the deceased, whereas the plates (3, 4) are produced following the burial or the cremation and are then to be attached together to definitively form the article for remembrance and identification of the deceased. A kit and a process for the production of this funerary article for identification and remembrance are also described.

7 Claims, 2 Drawing Sheets

(56) References Cited

U.S. PATENT DOCUMENTS

Figure 1:
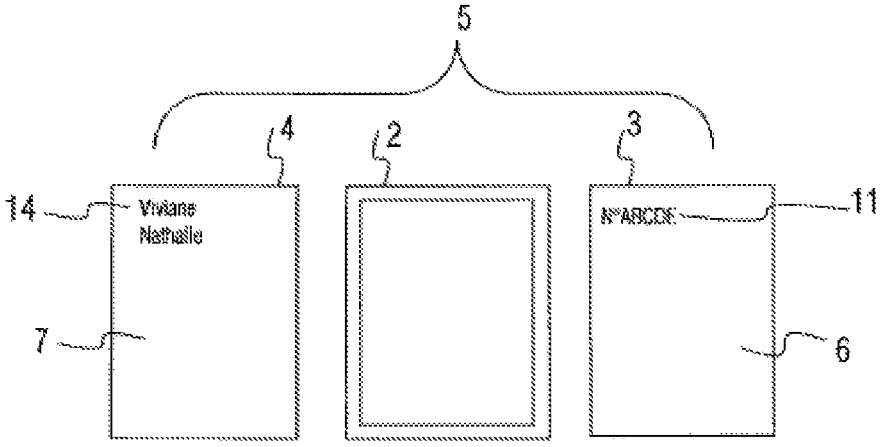

| | | | | |
|---|---|---|---|---|
| 6,105,287 | A | 8/2000 | Williams | |
| 7,210,203 | B1 | 5/2007 | Wimprine, Jr. | |
| 7,861,385 | B1 * | 1/2011 | Meyer | 27/1 |
| 7,934,298 | B1 * | 5/2011 | Ghazvini | 27/1 |
| 2004/0068905 | A1 | 4/2004 | Helgeson et al. | |
| 2007/0220788 | A1 * | 9/2007 | McCray | 40/124.5 |

* cited by examiner

TIMELESS IDENTIFICATION PASSPORT

BACKGROUND OF THE INVENTION

This invention pertains to the field of funerary articles and more particularly to objects that allow the perpetuation of the remembrance of the deceased.

It relates to a funerary article for the identification and perpetuation of the memory of a deceased individual in a timeless manner, made of unalterable material, comprising a premarked element and a device for identification and remembrance kept by the family members. The invention also has as its object a kit and a process for the production of this funerary article for identification and remembrance.

DESCRIPTION OF THE RELATED ART

The evolution of our society and the questions raised by new generations have upset our references to relationships to death, grieving, and preserving memory. With the development of cremation, burial plots located further and further geographically removed from the places of residence of the descendants, and the break-up of families, new questions are being posed today as to the symbolic and physical meaning of the death of a family member.

It has become necessary to respond to these changes by offering families the option of maintaining a link with their deceased family members by keeping close to them a physical trace of the deceased, and a material token of his/her memory, offering them the option of gathering at any location where this object is kept, an option that is very often not open to them.

Currently in the funeral sector, there are sites on the Internet allowing communication between relatives and friends affected by a death by putting online and exchanging photographs, messages or other information. However, these sites remain virtual locations.

SUMMARY OF THE INVENTION

The originality of this invention consists in the creation of a material basis for identification of a deceased individual, comprising two sets of items whose purposes and functions are different and complementary, where this basis allows a concrete expression of the memory and perpetual and timeless traceability of a deceased individual. It makes it possible to maintain a symbolic link with the deceased and to honor his/her memory, to identify him/her in order to accompany him/her and to find him/her regardless of the type of funeral that his/her death occasions.

The first of these two sets consists essentially of one item, marked in advance with an unalterable code that will be deposited in the coffin and then will remain with the body or with the ashes, by thus creating a symbolic link and allowing at the same time an identification of the remains, regardless of their condition subsequently. This item is assigned to the deceased when the funeral home takes charge of him or her.

The second set comprises items that comprise, on the one hand, the same code as that of the item that accompanies the remains of the deceased, and, on the other hand, personalized data, such as a drawing that represents a likeness, an ideal, a memory, or a passage of text, for example a poem, an indication of vital statistics, a message, etc., whereby these items are intended to be returned to the family or to be sent to a memorial site.

The problem resides in the fact that the funeral ceremonies take place very quickly after the death, but the production of an unalterable personalized element requires at least ten days, and for all practical purposes two to three weeks. A personalized element therefore cannot be used before the ceremony, and this element cannot be placed with the deceased at the desired time: the identification of the remains by means of an unalterable and timeless item that indicates the vital statistics of the deceased is thus impossible.

This invention responds to the concerns of the families by eliminating this drawback. It is based on the use of a funerary article whose assembly that is returned to the family is a device that comprises two attached plates, comprising the same code number as the first element placed in the coffin on the day of burial or with the ashes on the day of cremation. These plates comprise personalized data that relate to the deceased. This device will also make it possible to receive information about the deceased on a dedicated thematic site whether the body was buried or cremated.

According to the invention, a new instrument is created comprising three elements of which the destination and the functions are different and complementary. A first element, marked in advance with a code, is designed to be deposited with the body during the burial or the cremation. Two other elements are designed to be combined and returned to the family. One of them can be marked in advance with the same code as the element that accompanies the remains of the deceased, and the other is engraved or imprinted with personalized data in the days or weeks following the funeral ceremony. No matter what happens, the two elements ultimately bear the same code.

Whereas cremation removes any physical trace of deceased individuals, and whereas current practice is limited to issuing to the family the funerary urn containing the ashes, the inventors have chosen to develop an unalterable identification device for preserving an emotional and material trace of the individual. In the same manner, for those who live far from the grave site of their relatives, this device offers the option of gathering together.

Thus, this invention relates to a timeless funerary article for the identification and the perpetuation of the memory of a deceased individual, made of an unalterable material comprising:

On the one hand, an element that is marked with a unique code assigned to said deceased individual, And, on the other hand, a pair of plates held together by an attachment means, both being marked with said unique code, whereby the second plate comprises identification data of said deceased individual in natural language for constituting a device for identification and remembrance.

The unique code is assigned to said deceased individual on the day of the burial or the cremation. If, by accident, the two attached plates both bearing the unique code are separated under the effect of time or extreme conditions, it would also be possible to coordinate a code and an identity.

Likewise, it may be advantageous to display the address of an Internet site that hosts a database combining the codes and the identities on the two attached plates, as on the first element.

Unalterable material is defined as a rot-proof and unusable material that does not degrade over time, neither because of oxidation, nor because of moisture, nor because of ambient temperature variations. The objects achieved in such materials thus have a timeless nature. It is possible to cite, for example, ceramic, glass, stone, stainless steel, as well as numerous polymer materials. The three elements are produced in the same unalterable material or in different materials. However, as will be seen below, with the first element being likely to experience a great run-up in temperature if cremation is preferred, this element will not be made of a synthetic material. These materials are also suitable because of the option that they offer to be imprinted or engraved and to preserve this marking permanently.

Thus, according to a preferred characteristic of the funerary article according to the invention, the first element and the plates are made of an unalterable material that is selected from among baked, imprinted ceramics, engraved glass, engraved stone, stainless steel, or any other material that is adopted after having been tested. Preferably, the three items of the funerary article are made of ceramic because of its behavior at high temperature.

The first element, which can be in any form, is marked with a code that is assigned in a unique manner to a given deceased individual. The marking can be done by imprinting and baking ceramics, by engraving, or by any other suitable method. The assigned code is unique: it is assigned to a single set of three plates, once and for all, and will be assigned in a unique manner to a deceased individual. The assignment of a given code to a deceased individual is done from the time when the funeral home responsible for organizing the ceremony takes charge. The latter can immediately include it in a specific computer file for making accessible online a page that contains a certain number of data intended for the family and friends. The unique code can furthermore be used as a code for access to these data that are then distributed to a limited circle of individuals.

The funerary article that is the object of the invention also comprises a pair of plates, each bearing the same code number assigned to the deceased individual, held together by an attachment means. The plates are thus linked by an attachment means that unites them in an articulated or fixed manner, by one side or by a surface. It is possible, for example, to have recourse to two rings that hold the two plates by one side, such as the two flaps of a booklet. It is also possible to use a means for attaching plates back to back, by mechanical means (clamps, tabs, rings, etc.), or by gluing. Once the plates are combined, the unit constitutes a device for identification and remembrance, which will remain in the family's possession.

The first of the two plates that is marked with said unique code assigned to the deceased individual is identical to the illustration and to the code affixed to the first element. Combined with the second plate, it makes the link between the code and the illustration of the element accompanying the body and said second plate identifying the deceased that also bears the code number attached to the deceased.

The second plate comprises identification data of said deceased individual in natural language. With these data having, among other functions, that function of making possible the identification of the individual that rests in the grave, it is desirable that they provide at least the essential information of his/her vital statistics. Moreover, it is always possible to select the data that it is desired to see inscribed on this plate. They can, for example, imitate the page of an official passport-type document, which may or may not comprise a photo, or reproduce the signature of the deceased, an excerpt from one of his/her letters, or combine several types of said information. In an optional manner, the second plate can also comprise coded data, as well as the address of an Internet site that lists the identification data and codes.

In addition to the code and personalized data, the three elements of the funerary article that is the object of the invention, or only some of them, can be designed with an elaborate and original appearance. Enhanced color can be produced, for example, by using a unified tint or by reproducing an original creation, in such a way as to reinforce the function of symbolic representation of the device for identification and remembrance that is thus produced.

According to one preferred embodiment of the invention, the two plates have the same dimensions and are held attached back-to-back in such a way that the first plate constitutes a front of the device for identification and remembrance and the second plate constitutes a back of said device. The plates are, for example, rectangular, with the format of a postcard or else an identity document such as a passport.

In a preferred form of the invention, the plates are held together by an adhesive material that is placed between the plates close to their edge in such a way as to provide a gap between the two plates. The presence of this gap provides the possibility of inserting a memory object between the plates and removing it therefrom if desired.

The adhesive material that is used for producing the funerary article according to this invention can be a double-surface adhesive frame that occupies the entire length of the edge of the plates in such a way that the gap between the two plates is a definitively closed space that can accommodate DNA, an object, or a material that represents the deceased. In this case, the device is sealed, and it is not possible to recover its contents.

It thus is possible to preserve a letter, an intimate epitaph, a medal, a small piece of fabric, a photograph, or any other memory, or else a lock of hair, or another bodily substance of the deceased individual that can in particular contain DNA. The deceased himself/herself can, if he/she organizes his/her funeral, provide what he/she wishes to preserve.

In a convenient manner, the funerary article according to the invention also comprises, placed in the gap that is formed between the plates, a packet made of plastic material, able to contain DNA, an object or a material representing the deceased. It may advantageously be equipped with a hermetic closing means so as to better protect its contents and to prevent its dispersion.

According to a particular embodiment of this invention, the funerary article that is also marked with said unique code comprises a number of pairs of plates, each first plate marked with said unique code assigned to said deceased individual being attached to a second plate that is marked with identification data of said deceased individual in natural language. It is then possible to constitute several devices for identification and remembrance corresponding to the same deceased individual, and to send one of these devices to each of the members of the bereaved family.

The article as it was just described is presented in the state where it is ready for its reception by families. However, as it was explained above, it is not possible to carry out all of its elements at the same time. Thus, the element (and optionally the first plate) is advantageously marked in advance with the unique code and stored. The element is thus available when the Funeral Services take charge of the deceased, whereas the plates (or only the second plate) are produced following the burial or the cremation. The two plates are then to be attached together to definitively form the article for remembrance and identification of the deceased. It is therefore seen that it is convenient to use separately the set of elements designed to take part in the two-step production of the device that constitutes the funerary article that is the object of the invention.

This is why a kit for the production of a timeless funerary article for the identification and the perpetuation of the memory of a deceased individual is also the object of this invention, in particular as described above, comprising:

An element made of unalterable material, marked with a unique code that is assigned to said deceased individual, A first plate made of unalterable material, marked with said unique code, A second plate made of unalterable material, free from marking or marked with said unique code, of a suitable size for being assembled with said first plate, A means for attaching said first plate to said second plate, A housing that can contain at least said first plate, said second plate, and said attachment means, whereby said housing is equipped with a guide frame that can accommodate said first and second plates and said attachment means, and that can hold them in place during their assembly for forming a device for identification and remembrance.

All of the elements that are necessary for the production of the article according to the invention are contained in the housing, facilitating both the packaging and the implementation of the invention, and also ensuring the identity of the coded marks on the plates and the element.

One significant advantage of this kit is also that when the second plate has been marked with the selected data and any other personalization, if desired, it can be assembled with the first plate, using the attachment means (advantageously a double-surface adhesive tape), and this with excellent precision, which is essential because with the adhesive that is used being selected for its properties of connection solidity and longevity, it is difficult and even impossible to replace it. The assembly is guided by the guide frame of the housing. It is possible, for example, to resort to a shoulder made between the inside surface of the lateral walls of the housing, with the shoulder delimiting a space that allows the plates and the adhesive to be placed on one another without lateral play in such a way that they are exactly superposed. This assembly is done after having removed the protective film from the adhesive tape, first over a surface that is placed on a first plate, and then on the other surface that accommodates the second plate.

According to the selection of the recipient of the kit that is the object of the invention, the latter can comprise a means for attachment of the plates that consists of a double-surface adhesive frame, and a packet made of plastic material, optionally equipped with a hermetic closure that can hold an object or a material representing the deceased individual or a memory calling its individual to mind. With the adhesive frame being placed on the edge of the plates, it holds said packet in the central gap during the operation of combining plates.

A process for the production of a funerary article for the identification and the perpetuation of the memory of a deceased individual as described above is also the object of this invention. This process essentially comprises the stages that consist in:

i) Marking an element made of unalterable material with a unique code, ii) Assigning said unique code to a deceased individual and collecting the identification data of said deceased individual, iii) Placing said premarked element with the body or the ashes of the deceased, iv) Marking a plate made of unalterable material with at least said identification data in natural language, v) Assembling said thus marked plate with another plate, using an attachment means, for forming a device for identification and remembrance.

In accordance with the explanations given above, it is understood that stage i) for marking the element made of unalterable material with a unique code can be done in a first step, with the marked items being able to be stored as desired, from the very fact of their unalterable nature.

Stage ii) for assignment of the unique code to a deceased individual and for collecting the identification data of said deceased individual is done as soon as the Funeral Services take charge of the body.

In stage iii), said premarked element can be deposited in the coffin during the coffin closing ceremony. If the body is to be buried, it will remain there. If cremation is preferred, it can remain integral with the urn that accommodates the ashes of the deceased.

As soon as the Funeral Services have collected the identification data of the deceased that the family members want to see appear on the device for identification and remembrance, the marking of the second plate can start. When the plates are made of fine porcelain, which makes possible reproductions of photographs or highly accurate designs and an excellent accuracy of the coloring, special baking conditions have to be implemented, comprising several stages and lasting several days. Finally, the two plates are attached in stage v) to form the device for identification and remembrance according to the invention.

According to a particular embodiment of the process according to the invention, stage v) for combining the two plates is carried out by placing in order said first plate, said attachment means consisting of a double-surface adhesive frame from which its protective film has been removed, and said second plate, in a housing that is equipped with a guide frame, and by exerting pressure on the unit.

Furthermore, the process according to the invention can comprise, before stage v) for combining the two plates, a stage that consists in placing DNA, an object or a material that represents the deceased, optionally contained in a packet made of plastic material, in the gap that exists between said plates.

According to one preferred embodiment of the invention, the process comprises the recording, in a database, of the unique code that is assigned to the deceased individual, combined with identification data of said deceased individual in natural language. This coded number is thus the pivot of the coordination between the manufacturing of the identification document of the deceased, its inclusion in a database, and the management of its space on an Internet site.

This invention makes it possible to preserve a trace of the deceased with regard to his/her identity and his/her family circle. It facilitates the management of a delicate situation by a computer accounting but primarily softens it by a touch of humanity: as soon as the company in charge of the funeral has alerted the central agency, the death and the deceased will appear in databases of the site, and approaches by family members or those who would like to show their solidarity with professionals or management and church services will be facilitated. Numerous documents and typical letters will be obtained online and will make it possible to save precious time; orders can also be taken online by the companies to which the funeral has been entrusted because they will be listed as organizers of the ceremony.

This type of management already exists, certainly, on sites dedicated to funerals, but the way in which the use of computers and telecommunications has become part of everyday life should not have the corollary effect of preventing any more individualized and humanized manifestation of grief.

Thus, at a time and in a society where the tendency is toward the downplaying and denial of death, this invention takes a resolutely different and personalized stance—going as far as to combine—in the same proposal—recourse to the virtual and to a physical, and even bodily, symbol of the deceased. This constitutes a very bold gamble breaking with the existing systems.

BRIEF DESCRIPTION OF THE DRAWING FIGURES

Figure 2:
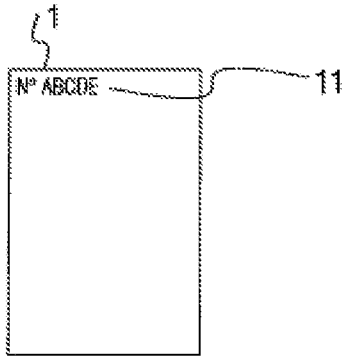
Figure 3:
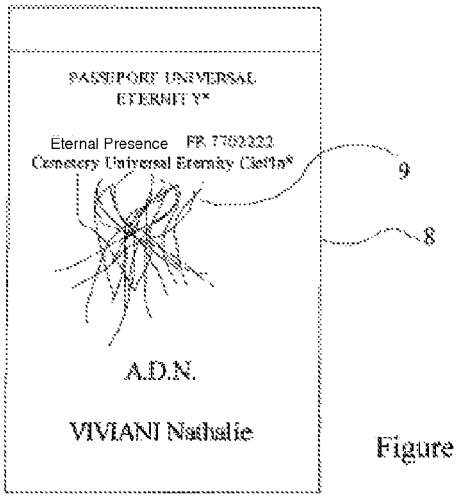
Figure 4:
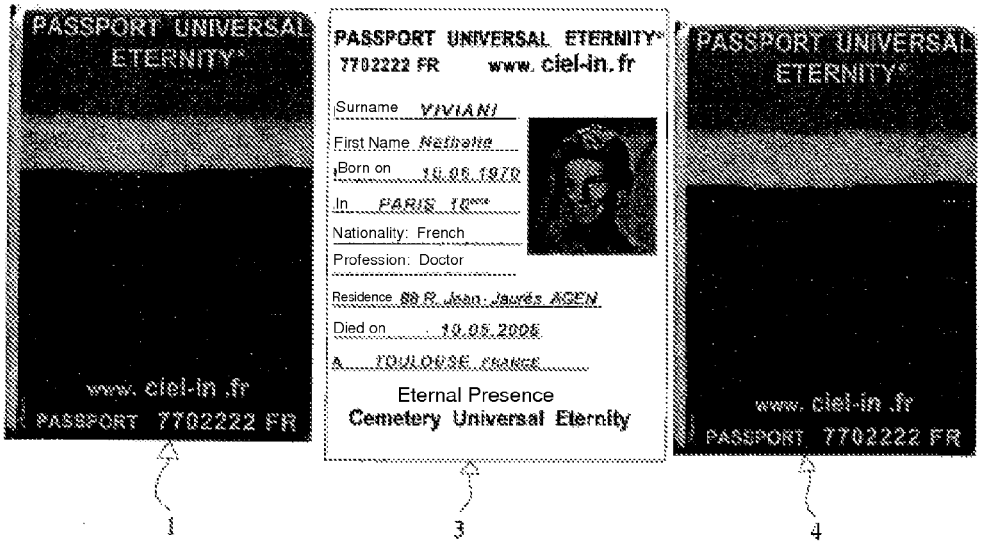

Other advantages and characteristics of the invention will emerge from reading the description below of an embodiment that is provided by way of nonlimiting example, illustrated by the attached drawings in which:

FIG. 1 is a diagrammatic view of a device for identification and remembrance, FIG. 2 is a diagrammatic view of a marked element, FIG. 3 is a representation of a packet that contains DNA, FIG. 4 is an illustration of the invention in passport form.

DETAILED DESCRIPTION OF THE INVENTION

Example 1

Structure

The funerary article as presented consists of three high-tech porcelain plates of a vertical rectangular shape that are designed to form, on the one hand (FIG. 1), the device for identification and remembrance 5, and, on the other hand (FIG. 2), the element 1 that is marked with a unique code. The three plates have separate and complementary functions in the process for identification of the deceased. The materials that are selected are resistant to any forms of erosion, which provides its durability to the product and to its contents, making possible the perpetual identification of the deceased.

The device for identification and remembrance 5 comes in the form of a back/front passport-type document. It consists of the pair of plates 3 and 4 that are held together by an adhesive attachment frame 2. The first plate 3 is marked with the unique code 11, and the second plate 4 comprises identification data 14 of the deceased in natural language, the unit constituting the device for identification and remembrance 5.

The element 1 and the first plate 3 are marked with the unique code 11 that is assigned to said deceased individual. It is noted that in the illustrated model, the first plate 3 and the marked element 1 are identical and bear the same coded number 11, but their destination is different.

The plates 3 and 4 as well as the element 1 are made of fine porcelain, a noble material because of its selected components that are subjected to a special baking process, making them unalterable. Specific techniques are used to preserve—in the decoration and in the inscriptions—the boldness of their colors during run-ups to high temperatures (1000° C.).

The marked element 1 is imprinted and numbered in advance. It is available and waiting for assignment with the operator of the Funeral Home company. The coded number 11 is assigned to the deceased as soon as the Funeral Home company takes charge of him or her, on the very day of death. From this time, the marked element 1 cannot be separated from the deceased who it will accompany in burial or in cremation. Its coded number 11 is directly and immediately recorded in an online file by the statement of the operator of the Funeral Home company. The plate 3 will be the front 6 of the identification device 5.

The second plate 4 that will constitute the back 7 of the device is completed by the identity data 14 of the deceased, with the same coded number 11 as the plate 3.

The second plate 4 is subsequently received by the operator of the Funeral Home company. It can then be sealed with the first plate 3 by the operator of the Funeral Home who previously used the gap made between the plates to preserve a fragment of tissue 9 from the deceased that contains DNA or any other element or document that can be included therein.

The plates 3 and 4 are assembled to form the device for identification and remembrance 5 using a double-surface polyethylene adhesive 2 with closed cells. Tested under difficult conditions, the adhesive proved very high-performing for its behavior over time in a temperature interval ranging from −40° C. to +80° C.

Example 2

Formal and Aesthetic Characteristics of Three Plates

For the element 1 and the second plate 3, two backgrounds created by an artist have been selected for their evocative power:

Sky and Sea for burial

Earth and Fire for cremation

Superimposed on these decorative backgrounds, which are covered by a specified legal protection, furthermore, it is possible to read the coded number 11 of the deceased, the reference of the Internet site, and the corresponding domain name.

The second plate 4 rests on a white background. Optionally, it could have color on demand. It will receive the same coded number 11 as its counterparts, as well as the corresponding domain name and the site. The categories of last name, first name, date of birth, birthplace, nationality, profession, residence, date of death, place of death, etc., appear on the front of the photograph of the deceased (optional). Finally, the mention "Eternal Presence" is placed on the last line.

Example 3

Manufacturing

The "passport" that is described above consists of 3 elements:

Element 1 that operates alone,

Plates 3 and 4, constituting the front 7 and the back 8, which work in an assembly in the device 5.

These three elements are complementary with different routes and destinations. In the event that plates 3 and 4 separate, it will always be possible to find the data for the missing surface in the database of the Internet site and to recreate the Passport.

Whereas the sites relative to the funeral allow the assignment of an address or a space online so that the bereaved family members connect with one another, the choice has been made to deposit the first plates 3 that correspond to the cover of the document for identification and remembrance 5 and that comprise the background and the coded number 11 assigned to the deceased with other selected Funeral Home companies. This coded number will be the pivot of the coordination between the manufacturing of the identification document 14 of the deceased, its inclusion in a database, and the management of its space on an Internet site.

The Funeral Home companies, while indicating the coded number 11 of the element 1 and the first plate 3, allocated to the deceased on the date of death, will provide to the manufacturer the identification data 14 of the latter to make it possible for the central agency, on the one hand, to write on the back surface 7 and to launch the manufacturing of the second plate 4, and, on the other hand, to include these data immediately in a private space of the site dedicated to preserving the memory of the deceased and to the management of the funeral.

The production of the device in porcelain requires about 20 days before the assembly of the two plates 3 and 4 and the inclusion of DNA or any other element 9 for constituting the complete identification device 5 can be initiated. Such an approach preserves the human contact of the clientele with an experienced professional and offers an aesthetic and personalized product at a time that is psychologically matched to grieving and the companionship of family members.

Example 4

Implementation

The procedure is different according to the funeral mode selected.

CREMATION: Element 1 that is premarked with the coded number 11 inscribed in the site dedicated to the memory will accompany the deceased during the ceremony. It will be returned with the urn, with which it is integral, to the Funeral Home company.

The complete device for identification and remembrance 5 will be received about 20 days after the death by the Funeral Home company operator who will assemble the two plates 3 and 4 to form the complete device 5 by including therein a tissue fragment containing DNA or any other element. The urn will be delivered to the family members of the deceased at the same time as the device for identification and remembrance 5.

BURIAL: The element 1 that is premarked with the coded number 11 inscribed in the site dedicated to the memory will have accompanied the deceased with which it is definitively integral in his/her coffin during his/her funeral. Subsequently, about 20 days after, the operator of the Funeral Home company will receive the second plate 4 for sealing the complete device 5 and for including therein the DNA element or any other element. The device for identification and remembrance 5 will be returned to the family members who will keep it and use it in the manner they deem most appropriate.

The invention claimed is:

1. A kit for the production of a timeless funerary article for the identification and the perpetuation of the memory of a deceased individual, the kit comprising:

an element (1) made of unalterable material, marked with a unique code (11) that is assigned to said deceased individual, said element (1) configured for being made integral with one of the group consisting of i) an urn and ii) a coffin, a first plate (3) made of unalterable material, marked with said unique code, a second plate (4) made of unalterable material, marked with said unique code, or free from marking, of a suitable size for being assembled with said first plate, a means (2) for attaching said first plate to said second plate, and a housing that can contain at least said first plate, said second plate, and said attachment means, wherein said housing is equipped with a guide frame that can accommodate said first and second plates and said attachment means, and that can hold said first and second plates and said attachment means, wherein, when assembled, said first and second plates and said attachment means form an identification and remembrance device (5), said identification and remembrance device (5) configured as a portable device to be retained by family of the deceased individual apart from said element (1).

2. The kit according to claim 1, wherein, said first element (1) is a plate, both said first element (1) and each of the first and second plates (3, 4) of said identification and remembrance device (5) imitate a page of a passport document, and said first element (1) and said second plate (4) including text indicating a passport, said unique code, and address of an Internet site hosting a database combining the unique code to said deceased individual.

3. A process for the production of a funerary article for the identification and the perpetuation of the memory of a deceased individual, comprising the steps of:

i) marking an element (1) made of unalterable material with a unique code (11), ii) assigning said unique code to a deceased individual and collecting the identification data (14) of said deceased individual, iii) placing said element (1) that is premarked with the unique code with the body or the ashes of the deceased individual, said element (1) being made integral with one of the group consisting of i) an urn and ii) a coffin, iv) marking a first plate (4) made of unalterable material with said unique code and said identification data in natural language, v) using a housing that can contain at least said first plate, a second plate, and an attachment means, wherein said housing is equipped with a guide frame that can accommodate said first and second plates and said attachment means, and using said guide frame to can hold said first and second plates and said attachment means, assembling said thus-marked first plate with the second plate, using the attachment means (2), for forming an identification and remembrance device (5), wherein said identification and remembrance device (5) is configured as a portable device to be retained by family of the deceased individual at locations apart from said element (1).

4. The process according to claim 3, wherein stage v) for combining the two plates (3, 4) is carried out by placing in order said first plate, said attachment means consisting of a double-surface adhesive frame from which a protective film has been removed, and said second plate, in the housing that is equipped with the guide frame, and by exerting pressure on the unit.

5. The process according to claim 3, further comprising, before stage v) for combining the first and second plates (3, 4), a stage that consists in placing DNA, an object or a material (8) that represents the deceased individual in the gap that exists between said plates.

6. The process according to claim 3, wherein, said first element (1) is a plate, both said first element (1) and each of the first and second plates (3, 4) of said identification and remembrance device (5) imitate a page of a passport document, and said first element (1) and said second plate (4) including text indicating a passport, said unique code, and address of an Internet site hosting a database combining the unique code to said deceased individual.

7. The process according to claim 3, wherein, said first element (1) is a plate, both said first element (1) and each of the first and second plates (3, 4) of said identification and remembrance device (5) imitate a page of a passport document, and said first element (1) and each of the first and second plates (3, 4) of said identification and remembrance device (5) include text indicating a passport, said unique code, and address of an Internet site hosting a database combining the unique code to said deceased individual.

* * * * *